US006085537A

United States Patent [19]

Takeda et al.

[11] Patent Number: 6,085,537

[45] Date of Patent: Jul. 11, 2000

[54] OUTDOOR UNIT OF SEPARATE TYPE AIR CONDITIONER

[75] Inventors: Yuji Takeda, Kusatsu; Mitsuo Nakanuma, Shiga; Koji Hatano, Otsu, all of Japan

[73] Assignee: Matsushita Electric Industrial Co., Ltd., Osaka, Japan

[21] Appl. No.: 09/155,792

[22] PCT Filed: Feb. 4, 1998

[86] PCT No.: PCT/JP98/00455

§ 371 Date: Oct. 5, 1998

§ 102(e) Date: Oct. 5, 1998

[87] PCT Pub. No.: WO98/34072

PCT Pub. Date: Aug. 6, 1998

[30] Foreign Application Priority Data

Feb. 4, 1997 [JP] Japan ..... 9-021559

[51] Int. Cl.[7] ..... F25D 23/12

[52] U.S. Cl. ..... 62/259.2; 62/298

[58] Field of Search ..... 62/259.2, 298; 312/400; 165/67

[56] References Cited

U.S. PATENT DOCUMENTS

| | | | |
|---|---|---|---|
| 2,477,055 | 7/1949 | Giffard . | |
| 3,415,315 | 12/1968 | Donaldson et al. . | |
| 4,082,142 | 4/1978 | Blackburn et al. | 165/76 |
| 4,306,615 | 12/1981 | Bolton et al. | 165/67 |
| 4,748,827 | 6/1988 | Chang | 62/272 |
| 5,638,693 | 6/1997 | Beak | 62/262 |

FOREIGN PATENT DOCUMENTS

| | | | |
|---|---|---|---|
| 57-149394 | 3/1981 | Japan . | |
| 3-88005 | 9/1991 | Japan . | |
| 4-20665 | 2/1992 | Japan . | |
| 5-164457 | 6/1993 | Japan | 62/298 |
| 6-159737 | 6/1994 | Japan | 62/259.2 |
| 7-208768 | 8/1995 | Japan . | |

*Primary Examiner*—Henry Bennett
*Assistant Examiner*—Melvin Jones
*Attorney, Agent, or Firm*—Ratner & Prestia

[57] ABSTRACT

Without sacrificing the working efficiency of screw fixing of an outdoor unit main body and top plate, it is intended to eliminate inconvenience such as staying of water around the screws, corrosion of screws, invasion of water into the machine, and projection of screws to outside. On a top plate 2, when installing the machine body, an outside surface 2*a* inclined to the installation surface is formed, and by fixing an outdoor unit main body 1 and the top plate 2 with screws 3 on this outside surface 2*a*, rainwater flows out from the inclined outside surface 2*a*, and staying of water in the fixing portion of the screws 3 can be prevented.

23 Claims, 3 Drawing Sheets

OUTDOOR UNIT OF SEPARATE TYPE AIR CONDITIONER

This application is a U.S. National Phase application of PCT International application PCT/JP98/00455.

TECHNICAL FIELD

The present invention relates to an outdoor unit in a separate type air conditioner having an indoor unit and an outdoor unit installed separately, and more particularly to fixing of the outdoor unit main body and its top plate.

BACKGROUND ART

In an outdoor unit of a conventional separate type air conditioner of this type, as shown in a perspective view in FIG. 6, constituent members disposed in the upper part of an outdoor unit main body 1, such as inner and outer connection piping junctions and electrical parts, are covered by a top plate 2 so as to isolate from the outside.

To fix the outdoor unit main body 1 and top plate 2, as shown in FIG. 7, the side of the top plate 2 was fixed to the side wall of the outdoor unit main body 1 with a screw 3, or, as shown in FIG. 8, the top plate 2 was fixed to the outdoor unit main body 1 with the screw 3 on its upper surface.

In such conventional constitution, however, when installing the outdoor unit of the separate type air conditioner on the verandah or other outside place, in the constitution as shown in FIG. 7, for example, when it is easy to work from above the top plate, its fixing job is difficult because there is a screw fixing part at the side of the top plate 2. Or, in the constitution shown in FIG. 8, since the screw fixing part is located on the same level as the upper surface of the top plate 2 installed horizontally, it is likely to impair the appearance by corrosion of screw due to rainfall, invasion of rainwater into the mechanism, or protrusion of screw head to outside.

The invention is intended to solve such conventional problems, and it is hence an object thereof to present an outdoor unit of separate type air conditioner capable of eliminating troubles such as staying of water around screw, corrosion of screw, invasion of water into machine, or protrusion of screw to outside, without sacrificing the working efficiency of screw fixing of outdoor unit main body and top plate.

SUMMARY OF THE INVENTION

To achieve the object, the outdoor unit of the separate type air conditioner of the invention is characterized by inclining the screw fixing part of the upper surface of the top plate at the time of installation so as to discharge water smoothly.

In the invention, the screw seat is higher than the surrounding surface, so that water may hardly invade into the screw fixing area.

Also in the invention, the height of the surface of the screw seat is set at a proper height so that the screw head may not project outside from the upper surface after tightening the screw.

The invention as set forth in claim 1 relates to an outdoor unit of separate type air conditioner having a top plate for covering constituent members disposed in the outdoor unit main body to protect from outside, in the upper part of the outdoor unit main body, in which an outside surface inclined to the installation surface of the outdoor unit is disposed on the top plate, and the top plate and the outdoor unit main body are fixed with a screw at the outside surface, and therefore, in this constitution, as the screw fixing part of the upper surface of the top plate is inclined when installing, staying of water in the screw fixing area can be prevented.

The invention as set forth in claim 2 relates to an outdoor unit of separate type air conditioner having a top plate for covering constituent members disposed in the outdoor unit main body to protect from outside, in the upper part of the outdoor unit main body, in which a screw seat having a higher seat surface than the surrounding surface is disposed in the upper surface of the top plate, and the top plate and the outdoor unit main body are fixed with screw at the screw seat, and therefore, in this constitution, since the screw seat having a higher seat surface than the surrounding surface is provided, invasion of water into the screw fixing area is prevented, and corrosion of screw can be prevented.

The invention as set forth in claim 3 relates to an outdoor unit of separate type air conditioner having a top plate for covering constituent members disposed in the outdoor unit main body to protect from outside, in the upper part of the outdoor unit main body, in which a screw seat having a higher seat surface than the surrounding surface and a smaller diameter than the screw head diameter is disposed in the upper surface of the top plate, and the top plate and the outdoor unit main body are fixed with screw at the screw seat, and therefore, in this constitution, since the screw seat having a higher seat surface than the surrounding surface and a smaller diameter than the screw head diameter is provided, invasion of water into the screw fixing area is prevented, and corrosion of screw can be prevented.

The invention as set forth in claim 4 relates to an outdoor unit of separate type air conditioner having a top plate for covering constituent members disposed in the outdoor unit main body to protect from outside, in the upper part of the outdoor unit main body, in which a low level surface lower than the surrounding surface, and forming a part as a drain part to reach the side of the top plate is disposed in the upper surface of the top plate, a screw seat having a higher seat surface than the height of the low level surface is disposed in the low level surface, and the top plate and the outdoor unit main body are fixed with screw at the screw seat, and therefore, in this constitution, since the screw seat is provided in the portion lower than the surrounding surface and forming a drain part in a part in the upper surface of the top plate, invasion of water into the screw fixing area is prevented more securely, and corrosion of screw can be prevented.

The invention as set forth in claim 5 relates to the invention as set forth in claim 4, in which the height of the seat surface is set to such a height that the screw head may not project outside of the top plate after tightening the screw, and in this constitution, therefore, since projection of screw to outside is eliminated, and the appearance may be enhanced in its design.

BEST MODE OF CARRYING OUT THE INVENTION

Figure 6:
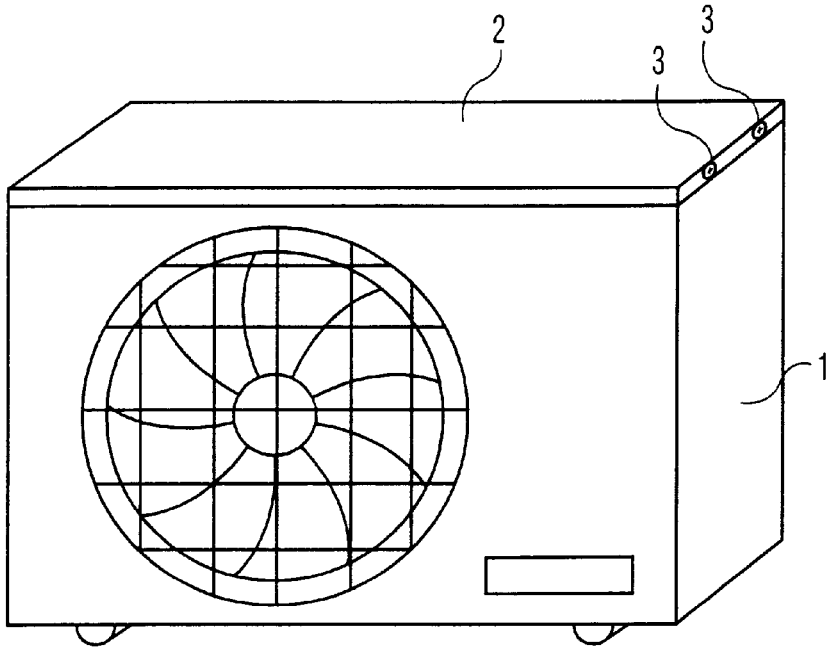
FIG. 6 PRIOR ART
FIG. 6 is a perspective view showing an example of a conventional outdoor unit.
Figure 7:
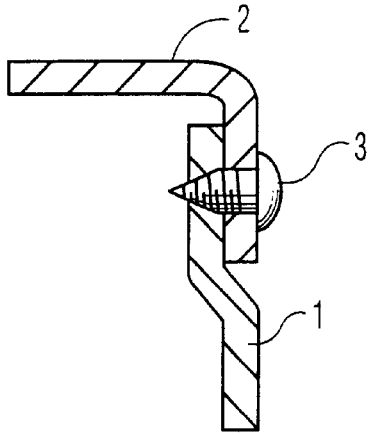
FIG. 7 PRIOR ART
FIG. 7 is a sectional view of a screw fixing part in a conventional outdoor unit.
Figure 8:
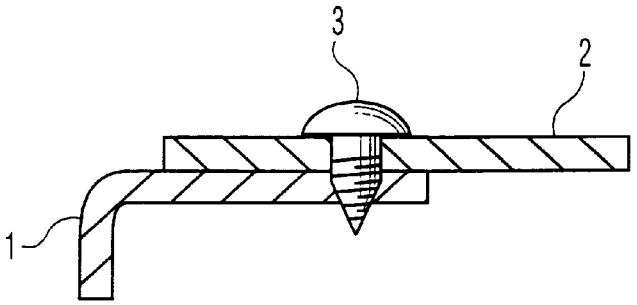
FIG. 8 PRIOR ART
FIG. 8 is a sectional view showing other example of screw fixing part in a conventional outdoor unit.

Embodiments of the invention are described below together with the drawings. Members corresponding to the members explained in FIG. 6 to FIG. 8 are identified with same reference numerals, and their detailed description is omitted.

Figure 1:
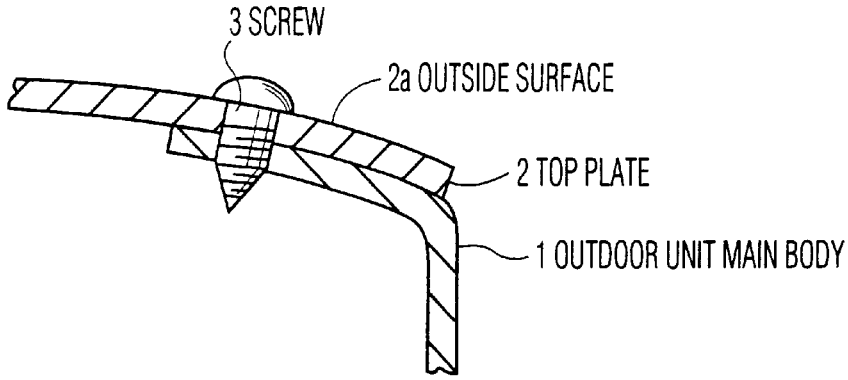
FIG. 1 is a sectional view showing essential parts of an outdoor unit for explaining a first embodiment of the invention.

FIG. 1 is a sectional view showing essential parts of an outdoor unit for explaining a first embodiment of the invention, in which reference numeral 1 is an outdoor unit main body of a separate type air conditioner, and 2 is a top plate of the outdoor unit of the separate type air conditioner, and in the top plate 2, an outside surface 2*a* inclined to the plane of installation at the time of installation of the main body is formed, and at this outside surface 2*a*, the outdoor unit main body 1 and the top plate 2 are fixed by using screws 3.

In such constitution, rainwater flows along the inclined outside surface 2*a*, so that water may not stay in the fixing portion of the screws 3.

Figure 2:
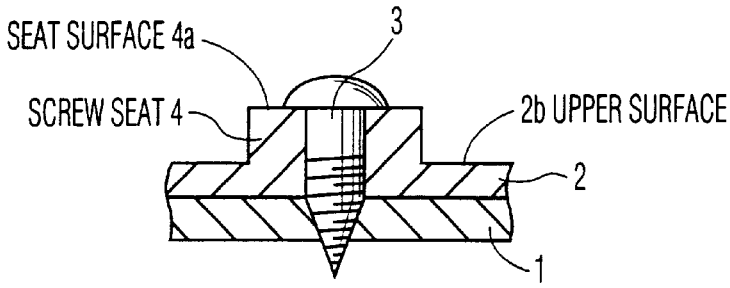
FIG. 2 is a sectional view showing essential parts of an outdoor unit for explaining a second embodiment of the invention.

FIG. 2 is a sectional view showing essential parts of an outdoor unit for explaining a second embodiment of the invention, in which the outdoor unit main body 1 and the top plate 2 are fixed with screws 3 on a screw seat 4 formed integrally with the top plate 2 so as to have a higher seat surface 4*a* than the upper surface 2*b* of the top plate 2.

In such constitution, if rainwater stays on the upper surface 2*b* of the top plate 2, it does not invade into the fixing portion (screw portion) of the screws 3 at higher position than the surrounding, so that corrosion of screws 3 may be prevented.

Figure 3:
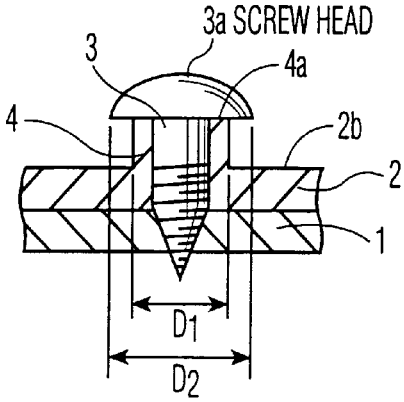
FIG. 3 is a sectional view showing essential parts of an outdoor unit for explaining a third embodiment of the invention.

FIG. 3 is a sectional view showing essential parts of an outdoor unit for explaining a third embodiment of the invention, in which the outdoor unit main body 1 and the top plate 2 are fixed with screws on a screw seat 4 formed integrally with the top plate 2, having a higher seat surface 4*a* than the upper surface 2*b* of the top plate 2, with its outside diameter D1 smaller than the diameter D2 of the head 3*a* of the screws 3.

In such constitution, if rainwater stays on the upper surface 2*b* of the top plate 2, it does not invade into the fixing portion of the screws 3, and corrosion of the screws 3 is prevented. Moreover, since rainwater hardly gets under the head 3*a* of the screws 3, invasion of water into the outdoor unit main body 1 may be effectively prevented.

Figure 4:
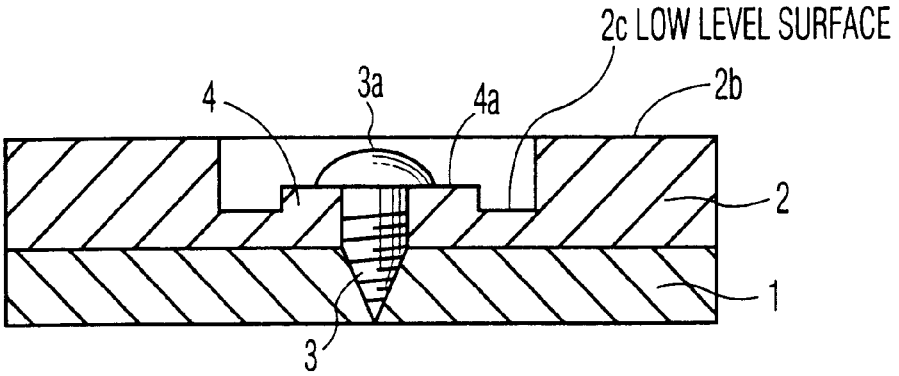
FIG. 4 is a sectional view showing essential parts of an outdoor unit for explaining a fourth embodiment of the invention.
Figure 5:
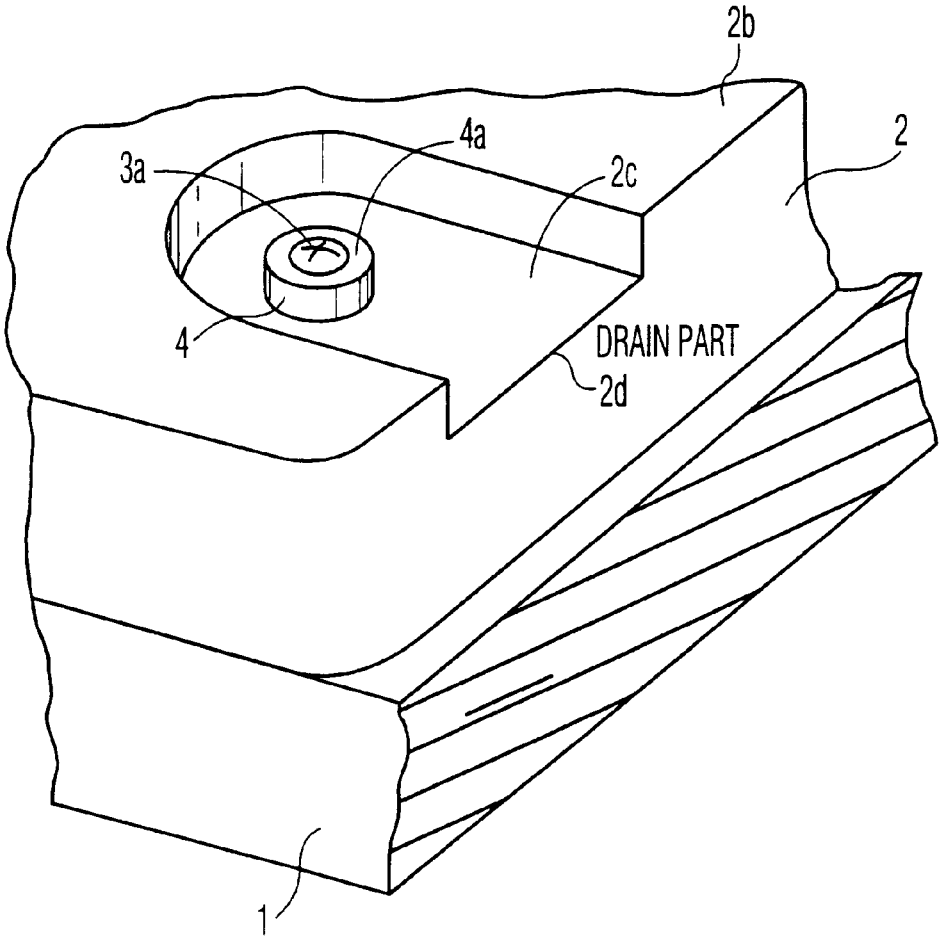
FIG. 5 is a perspective view of essential parts of the outdoor unit in FIG. 4.

FIG. 4 is a sectional view showing essential parts of an outdoor unit for explaining a fourth embodiment of the invention, and FIG. 5 is a perspective view of essential parts in FIG. 4, in which the top plate 2 has a low level surface 2*c* lower than the upper surface 2*b*, and a screw seat 4 having a higher seat surface 4*a* than this low level surface 2*c* is formed on the low level surface 2*c*. On this screw seat 4, the outdoor unit main body 1 and the top plate 2 are fixed with screws 3.

In this constitution, as shown in FIG. 5, part of the low level surface 2*c* is opened as a drain part 2*d* at one side of the top plate 2, and rainwater is discharged through the drain part 2*d*, and water does not invade into the fixing portion of the screws 3, and corrosion of the screws 3 can be more securely prevented.

Moreover, by setting the dimensions so that the seat surface 4*a* at the upper surface of the screw seat 4 may be lower than the upper surface 2*b* of the top plate 2, and that the head 3*a* of the screws 3 may not project to the upper surface 2*b* side, and therefore the screws 3 will not disagreeably project outside, and the appearance of the design of the entire outdoor unit may be enhanced.

INDUSTRIAL APPLICABILITY

As described herein, in the indoor unit of separate type air conditioner of the invention, since the screw fixing portion for fixing the outdoor unit main body and top plate is provided on an inclined surface of the top plate, staying of water on the screw fixing portion can be prevented.

By forming the screw seat having a higher seat surface than the surrounding surface on the top plate, invasion of water into the screw fixing portion can be prevented, and corrosion of screws can be prevented.

By forming the screw seat higher than the surrounding surface and having a smaller diameter than the screw head diameter on the top plate, invasion of water into the screw area is prevented and corrosion of screws can be prevented, and also invasion of water into the machine is prevented.

On the low level surface lower than the surrounding surface and forming a drain portion in part on the top plate, by forming the screw seat higher than this low level surface, water is discharged more smoothly, and invasion of water into the screw fixing portion can be prevented more efficiently, and corrosion of screws can be prevented.

Also by eliminating projection of screws from the top plate, the appearance of the design of the outdoor unit may be enhanced.

What is claimed is:

1. An outdoor unit of separate type air conditioner comprising:

an outdoor unit main body including a side plate, constituent members disposed in the outdoor unit main body, a top plate, and a screw fixing the top plate to the outdoor unit main body, wherein said top plate has an outside surface inclined to the side plate of the outdoor unit main body, and said screw is mounted in said inclined outside surface.

2. An outdoor unit used in a separate type air conditioner comprising:

(a) a functional member for air conditioning, and (b) a box containing said functional member, said box including:

(1) a side plate, (2) a top plate disposed in an upper direction of said side plate, said top plate having a junction, (3) a junction member installed from an upper direction of said top plate side, so as to may be mounted and dismounted from the upper direction of said top plate, in order to join said side plate and said top plate at said junction, and (4) water staying preventive means disposed at said junction, for preventing i) staying of water, and ii) corrosion of said junction member due to water.

3. An outdoor unit of claim 2, wherein said junction member has a screw.

4. An outdoor unit of claim 2, wherein said water staying preventive means is an inclined surface formed on said top plate, and said junction member is disposed on said inclined surface, so that water flow down along said inclined surface without staying at said junction.

5. An outdoor unit of claim 2, wherein said water staying preventive means is a bump formed integrally on said top plate, and having a higher seat surface than the surrounding surface, and said junction member is disposed on said bump.

6. An outdoor unit of claim 2, wherein said junction member has a screw, said water staying preventive means is a screw seat having a higher seat surface than the surrounding surface, and said screw is placed in said screw seat.

7. An outdoor unit of claim 2, wherein said junction member has a screw with a head, said water staying preventive means is a screw seat disposed on said top plate, having a higher seat surface than the surrounding surface and a s smaller diameter than the diameter of said head, and said screw is placed in said screw seat.

8. An outdoor unit of claim 7, wherein said screw seat is formed integrally with said top plate.

9. An outdoor unit of claim 2, wherein said water staying preventive means has a drain part with a recessed surface from the surface of said top plate, and a bump formed in said drain part, said junction member is disposed on said bump, and water in the drain part flows down.

10. An outdoor unit of claim 9, wherein said drain part and bump are formed integrally with said top plate.

11. An outdoor unit of claim 2, wherein said junction member has a screw, said water staying preventive means has a drain part with a lower surface than the surrounding surface, and a screw seat with a higher surface than said drain part and formed in said drain part, and said screw is placed in said screw seat.

12. An outdoor unit of claim 11, wherein said screw has a head, and said head is positioned at a lower position than the surface of said top plate.

13. An assembling method of outdoor unit having both easy working efficiency and long durability, comprising the steps of:

(a) supplying a side plate, a top plate, and a functional member for air conditioning, (b) forming water staying preventive means for preventing i) staying of water, and ii) corrosion due to water, at said top plate, (c) disposing said functional member in a container enclosed by said side plate, (d) disposing said top plate having said water staying preventive means by covering the opening of said container, and (e) mounting a junction member from above said top plate, at the junction of said top plate, and joining said top plate and side plate.

14. An assembling method of outdoor unit of claim 13, wherein said junction member has a screw, and said step (e) is a step of fitting said screw to said junction from above said top plate, and joining said top plate and side plate.

15. An assembling method of outdoor unit of claim 13, wherein said step (b) is a step of forming a inclined surface as said water staying preventive means at said top plate, and wherein water flows flow along said inclined surface without staying at said junction.

16. An assembling method of outdoor unit of claim 13, wherein said step (b) is a step of disposing a bump having a higher seat surface than the surrounding surface, as said water staying preventive means, on said top plate, and said step (e) is a step of fitting said junction member on said bump from above said top plate, and joining said top plate and side plate.

17. An assembling method of outdoor unit of claim 16, wherein said screw seat is formed integrally with said top plate.

18. An assembling method of outdoor unit of claim 13, wherein said screw seat has a screw, wherein said step (b) is a step of disposing a screw seat having a higher seat surface than the surrounding surface, as said water staying preventive means, integrally on said top plate, and said step (e) is a step of fitting said screw to said screw seat from above said top plate, and joining said top plate and side plate.

19. An assembling method of outdoor unit of claim 13, wherein said junction member has a screw with a head, wherein said step (b) is a step of disposing a screw seat having a higher seat surface than the surrounding surface and a smaller diameter than the diameter of said head, as said water staying preventive means, on said top plate, and said step (e) is a step of fitting said screw to said screw seat from above said top plate, and joining said top plate and side plate.

20. An assembling method of outdoor unit of claim 13, wherein said step (b) is a step of disposing a drain part having a recessed surface from the surface of said top plate, and a bump formed in said drain part, as said water staying preventive means, on said top plate, and said step (e) is a step of fitting said junction member to said bump from above said top plate, and joining said top plate and side plate.

21. An assembling method of outdoor unit of claim 20, wherein both said drain part and said bump are integrally formed with said top plate.

22. An assembling method of outdoor unit of claim 13, wherein said junction member has a screw, wherein said step (b) is a step of disposing a drain part having a recessed surface from the surface of said top plate and a screw seat formed in said drain part, as said water staying preventive means, on said top plate, and said step (e) is a step of fitting said screw to said screw seat from above said top plate, and joining said top plate and side plate.

23. An assembling method of outdoor unit of claim 22, wherein said screw has a head, and said head is positioned at a lower position than the surface of said top plate at said step (e).

* * * * *